United States Patent [19]

Nedoluha

[11] Patent Number: 4,696,248

[45] Date of Patent: Sep. 29, 1987

[54] OUTHAUL BOOM END PART FOR SAILBOARD BOOM ASSEMBLY

[75] Inventor: Heinz F. Nedoluha, Salzburg, Austria

[73] Assignee: The Coleman Company, Inc., Wichita, Kans.

[21] Appl. No.: 811,022

[22] Filed: Dec. 19, 1985

[51] Int. Cl.[4] ..... B63B 15/00

[52] U.S. Cl. ..... 114/39; 114/97; 114/109

[58] Field of Search ..... 114/39.2, 97–99, 114/89, 109

[56] References Cited

U.S. PATENT DOCUMENTS

| | | | |
|---|---|---|---|
| 3,574,900 | 4/1971 | Emery | 114/218 |
| 4,319,536 | 3/1982 | Schweitzer et al. | 114/99 |
| 4,334,488 | 6/1982 | Jolivet | 114/39.2 |
| 4,437,424 | 3/1984 | Lord | 114/39.2 |
| 4,562,787 | 1/1986 | Adamek et al. | 114/39 |

FOREIGN PATENT DOCUMENTS

| | | | |
|---|---|---|---|
| 2423250 | 11/1975 | Fed. Rep. of Germany | 114/39.2 |
| 3326617 | 2/1985 | Fed. Rep. of Germany | 114/97 |
| 83/00313 | 2/1983 | World Int. Prop. O. | 114/97 |

OTHER PUBLICATIONS

*Wind Surf*, Mar. 1983, vol. 12, No. 6, p. 12, Rip Curl ad.

*Primary Examiner*—Joseph F. Peters, Jr.
*Assistant Examiner*—Stephen P. Avila

[57] ABSTRACT

An outhaul boom end part for a sailboard boom assembly is molded integrally from plastic. The outhaul boom end part is generally U-shaped and includes a pair of tubular portions for attachment to the booms and a central portion. The central portion is provided with a pair of jam cleat slots which extend generally parallel to a plane which bisects the U-shaped part, and a sleeve is mounted on the central portion with its excess perpendicular to the plane of the U-shaped part.

13 Claims, 12 Drawing Figures

OUTHAUL BOOM END PART FOR SAILBOARD BOOM ASSEMBLY

BACKGROUND

This invention relates to sailboats, and, more particularly, to an outhaul boom end part for a sailboard boom assembly.

The boom assembly of a sailboard typically includes a pair of elongated tubular booms which extend along opposite sides of the sail, an inhaul boom end part which is attached to the mast, and an outhaul boom end part which cooperates with an outhaul line for tensioning the sail.

The outhaul line is conventionally secured by cleats which are mounted on the booms U.S. Pat. No. 3,574,900 describes cleats which are commonly used. These cleats are expensive, are subject to breaking, and protrude from the booms so as to interfere with some motions of the boom and movement of the sailor's hands along the boom. The cleat illustrated in FIGS. 5–10 of the patent includes a bridge, and the outhaul line must be carefully threaded through the bridge.

The conventional outhaul cleating arrangement positions the cleat on the boom in a location that is not parallel with the direction of force required for tensioning the outhaul line. This can make cleating more difficult. Removal of the line from the boom necessitates uncleating the two ends of the line and lifting an intermediate loop of the line up and away from a boom end sheave. The conventional arrangement requires threading of the line through the sheaves and cleat bridges on each use.

SUMMARY OF THE INVENTION

The outhaul boom end part eliminates external cleats and sheaves on the booms. A pair of recessed cleat slots are molded into an integrally molded outhaul boom end part, and the cleats are aligned with the direction of force applied by the sailor on the outhaul line. Cleating is accomplished easily and quickly by pulling straight out on the outhaul line and then pulling upwardly when proper tension on the line is achieved. A sheave is mounted in a recessed portion of the outhaul end part and rotates about an axis which is perpendicular to the plane of the outhaul end part. The outhaul line can therefore be rigged and derigged without removing the line from the block on the sail tack.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
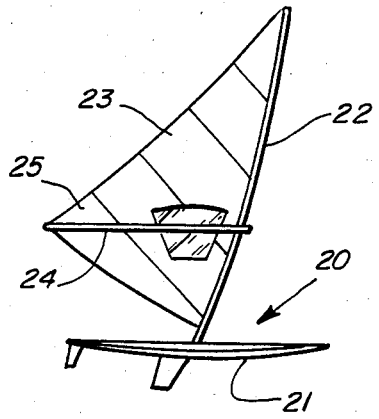
FIG. 1 is a side elevational view of a sailboard which is equipped with an outhaul boom end part formed in accordance with the invention.

Referring first to FIG. 1, a conventional sailboard 20 includes a board 21, a mast 22 which is mounted on the board, and a sail 23 which is supported by the mast. A pair of booms 24 are attached to the mast and extend along opposite sides of the sail for tensioning the tack 25 of the sail and for providing a hand hold for the sailor. With the exception of the boom assembly which will be described in part hereinafter, the sailboard 20 is conventional and well known in the art.

Referring now to FIGS. 2–12, an outhaul boom end part 27 is attached to the aft ends of the booms 24. The outhaul boom end part is generally U-shaped and includes a pair of tubular portions 28 and 29 and a curved central portion 30 which connects the tubular portions. Each of the booms 24 engages one of the tubular portions 28 and 29, and the end of the boom abuts a shoulder 31 on the tubular portion. Each boom is removably secured on the tubular portion, preferably by a spring-loaded latch 32 (FIG. 12) which extends through cross bores 33 (FIGS. 4 and 5) in the tubular portion.

Figure 11:
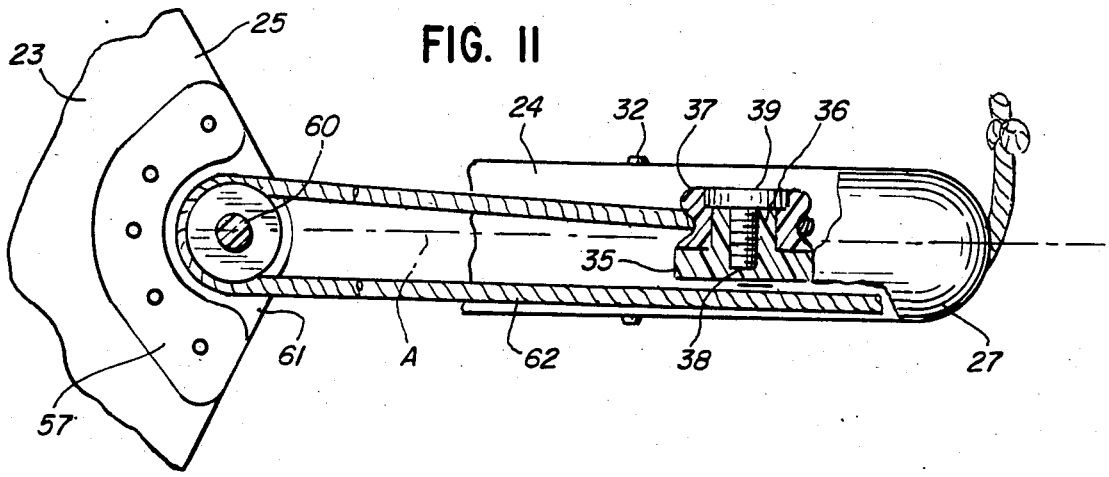
FIG. 11 is a fragmentary elevational view, partially broken away, taken along the line 11—11 of FIG. 10.

The central portion 30 includes a generally toroidal-shaped portion 34 which extends arcuately between the tubular portions 28 and 29 and a flat portion 35 which extends between the ends of the toroidal portion. Referring to FIG. 11, a cylindrical bushing 36 extends perpendicularly from the flat portion 35, and a sheave 37 is rotatably mounted on the bushing. The sheave is retained on the bushing by a screw 38 which is screwed into the internally threaded bushing. The head 39 of the screw is positioned within an annular recess 40 (FIG. 6) in the sheave. The sheave rotates about an axis which extends perpendicularly to the mid-plane of the U-shaped boom end part 27, i.e., a plane A (FIG. 11) which bisects the two tubular portions 28 and 29 and the two booms 24.

Figure 8:
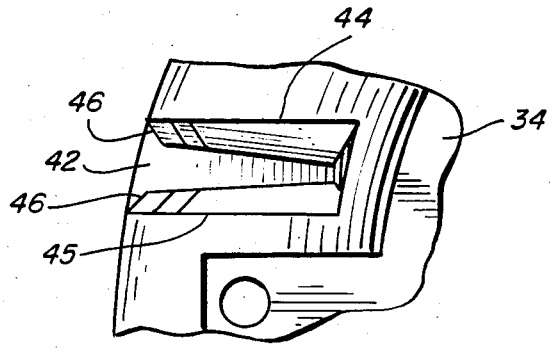
FIG. 8 is an enlarged fragmentary view of a portion of FIG. 4.
Figure 9:
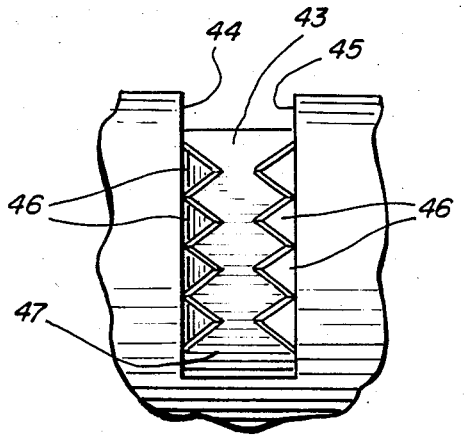
FIG. 9 is a fragmentary elevational view taken along the line 9—9 of FIG. 7.
Figure 2:
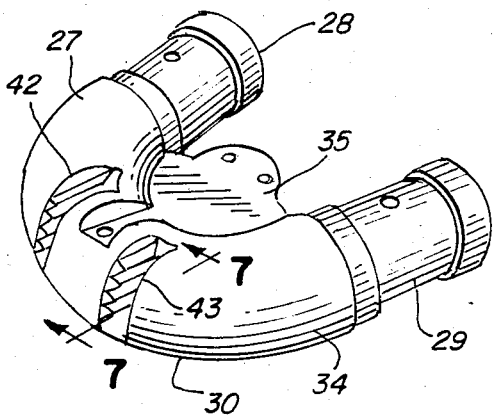
FIG. 2 is a perspective view of the bottom of the outhaul boom end part.
Figure 3:
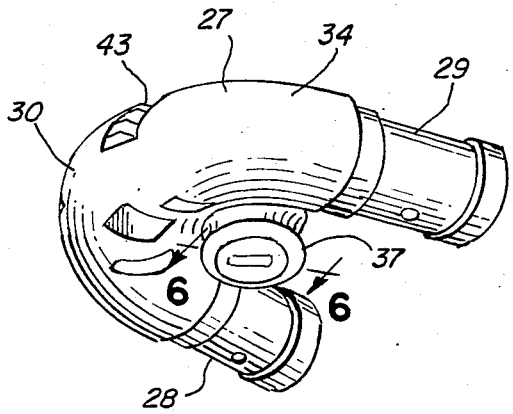
FIG. 3 is a perspective view of the top of the outhaul boom end part.
Figure 4:
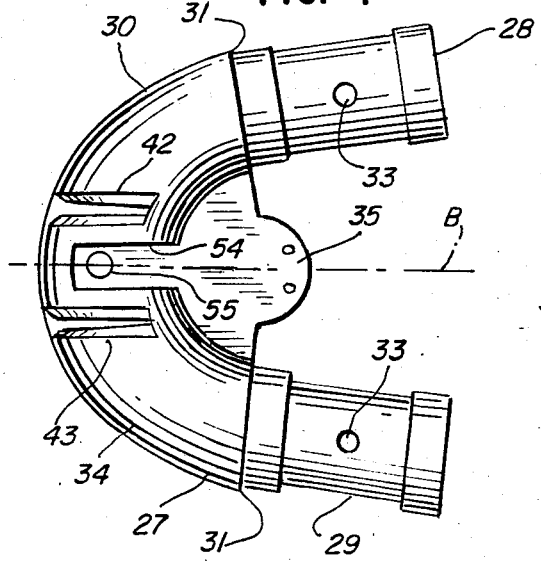
FIG. 4 is a bottom plan view of the outhaul boom end part.
Figure 5:
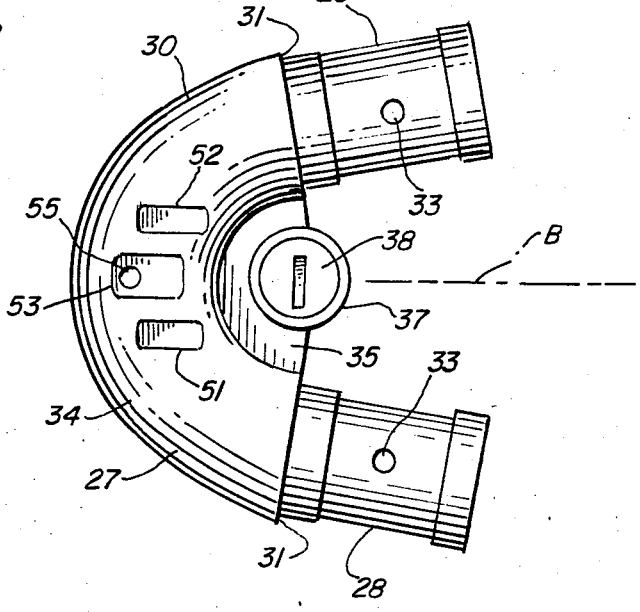
FIG. 5 is a top plan view of the outhaul boom end part.
Figure 6:
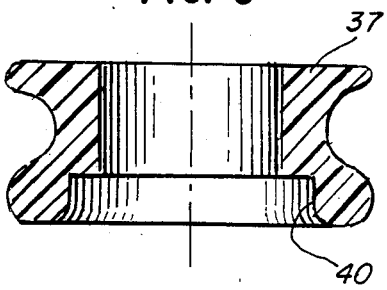
FIG. 6 is an enlarged sectional view of the sheave taken along the line 6—6 of FIG. 3.

A pair of jam cleat slots 42 and 43 are provided in the rear portion of the toroidal portion 34. Each of the cleat slots is defined by a pair of substantially parallel side surfaces 44 and 45 (see FIGS. 8 and 9), and a plurality of cleat ridges 46 extend along each of the side surfaces in a direction which is parallel to the mid-plane A of the boom end part. The bottom of each cleat slot is formed by a bottom surface 47 (FIG. 7) which is inclined relative to the cleat ridges and to the mid-plane A. As can be seen in FIG. 8, the peaks of the opposing cleat ridges 46 are inclined relative to the side surfaces 44 and 45 and diverge outwardly as they extend rearwardly so that the distance between the peaks of opposing ridges is less at the front of the ridges than at the back of the ridges.

The side surfaces 44 and 45 of the cleat surfaces extend parallel to a plane B (FIGS. 4 and 5) which bisects the angle of the U-shaped end part which is formed by the tubular portions 28 and 29. Each cleat slot extends through an arc of greater than 90° in the outer surface of the toroidal portion (see FIG. 7).

The toroidal portion 34 is provided with recesses 51 and 52 (FIG. 5) on the side opposite the cleat slots 42 and 43, and the recesses are aligned with the cleat slots. A third recess 53 is aligned with a recess 54 (FIG. 4) between the cleat slots, and a bore 55 extends between the recesses 53 and 54.

Figure 10:
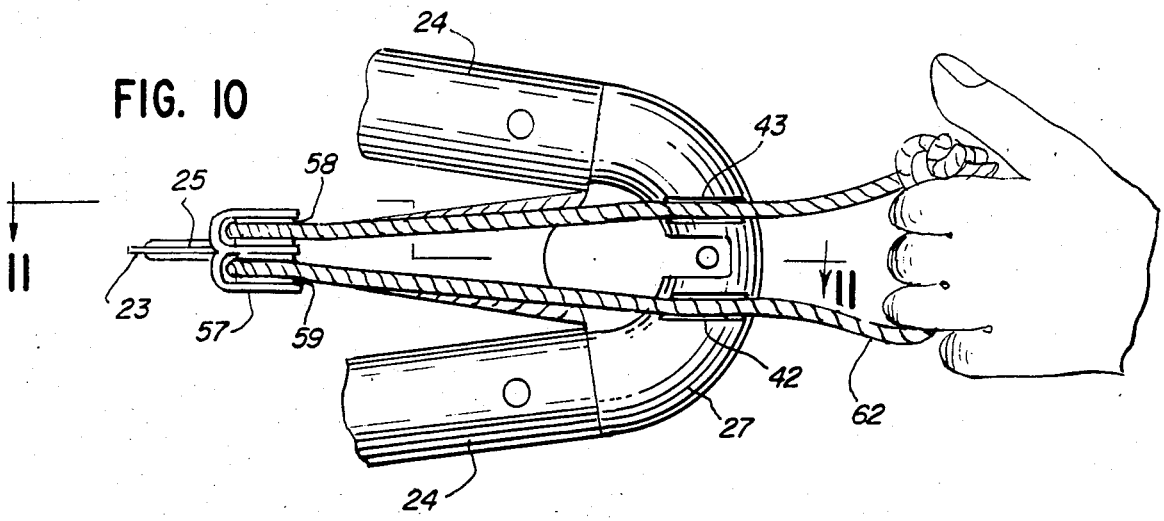
FIG. 10 is a fragmentary bottom plan view showing the outhaul boom end part being attached to the sail.
Figure 12:
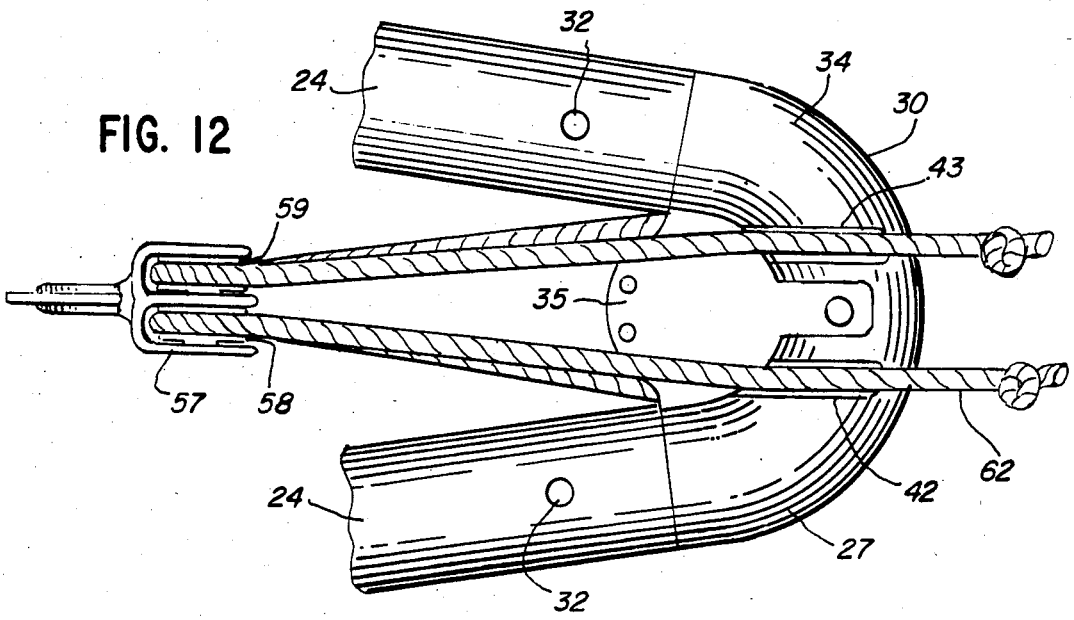
FIG. 12 is a view similar to FIG. 11 showing both ends of the outhaul line secured.

Referring to FIGS. 10–12, the sail 23 is equipped with a conventional block 57 which includes a pair of sheaves 58 and 59. The sheaves are rotatably mounted on a pin 60 which extends through a mounting plate 61 which is attached to the tack 25 of the sail.

Figure 7:
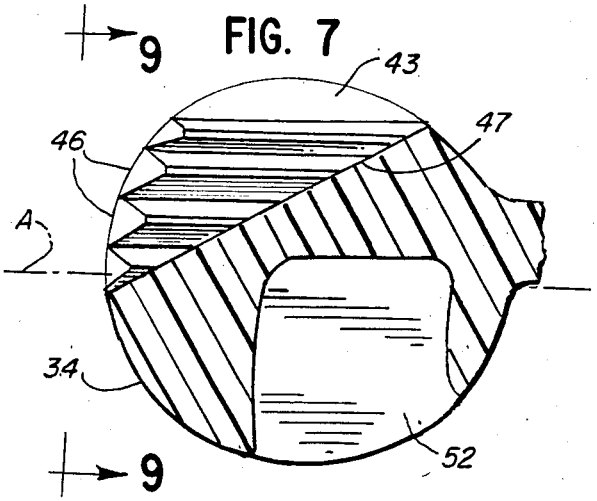
FIG. 7 is an enlarged fragmentary sectional view taken along the line 7—7 of FIG. 2.

The outhaul boom end part 27 is normally secured to the booms 24 so that the sheave 37 faces upwardly and the cleat slots 42 and 43 face downwardly. One end of an outhaul line 62 is secured in one of the cleat slots 42 or 43, and the outhaul line is fed through one of the sheaves of the block 57, around the sheave 37 on the outhaul boom end part, and through the other sheave of the block 57. The second end of the outhaul line is pulled to exert the desired tension on the sail and mast, and the second end of the line is then pulled into the other cleat slot to anchor the line. As can be seen in FIG. 7, the bottom 47 of the cleat slot extends at an angle relative to the cleat ridges 46, and the outhaul line is cleated merely by pulling the line upwardly in FIG. 11 to wedge the line between the opposed cleat ridges. The tension exerted on the line by the sail causes the line to wedge more tightly between the diverging peaks of the opposed cleat ridges.

The tension on the sail can be adjusted as desired merely by pulling one of the ends of the outhaul line 62 out of the cleat slot, adjusting the tension on the line, and then pulling the line back into the cleat slot. The cleat slots are substantially aligned with the direction of force which is exerted on the line by the sailor, and cleating is accomplished simply by pulling the line rearwardly and then pulling upwardly into the cleat slot when the desired tension exists. Alternatively, the ends of the line can be tied together, and both ends can be pulled and cleated simultaneously.

The axis of the sheave 37 on the outhaul boom end part extends perpendicularly to the mid-plane A of the boom and parallel to the plane of the sail. The outhaul line can thereby be rigged and derigged from the outhaul boom end part without removing the line from the sail tack block 57. The outhaul line is removed from the boom end part merely by uncleating the ends of the line and lifting the intermediate loop up and away from the sheave 37 on the boom end part. The outhaul line can be reattached to the boom end part by following the reverse procedure. Conventional outhaul arrangements generally require the outhaul line to be threaded through the sheaves and the cleat bridges for each use.

The cleats on the boom end part are recessed below the surface of the boom end part so that they are protected against breakage and do not interfere with the smooth surface of the boom end part. The entire boom end part, with the exception of the sheave 37, can be molded integrally from plastic, thereby reducing the cost of the part and providing a stronger, more durable part. The part can be molded in a two-part mold, and the parting line of the mold is aligned with the mid-plane A. The resilience of the cleat ridges is such that the mold part which forms the ridges can be pulled away from the ridges without damaging the ridges.

Although in the specific embodiment illustrated, the boom end part includes two cleat slots, one end of the outhaul line could be secured by means other than a jam cleat. For example, a knot in the line could engage a pair of shoulders on the boom end part. The tension on the outhaul line could still be adjusted as desired by pulling the other end of the outhaul line and securing it in the cleat. However, the use of two cleat slots increases the versatility of the boom end part, permits the tension on the outhaul line to be adjusted at either end of the outhaul line, and permits the sailor to adjust the lengths of the free ends of the outhaul lines which extend beyond the cleats so that they are substantially equal as illustrated in FIG. 12. Further, although the preferred embodiment of the boom end part also includes a sheave 37 which is rotatably mounted on the boom end part, a nonrotatable sheave or pin could be used.

The invention was described in conjunction with a double-sheaved block 57 on the sail. However, the invention can also be used with other sail structures, for example, a single eye in the sail.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. An outhaul boom end part for a sailboard boom assembly having a pair of booms which lie in a first plane, the boom end part being generally U-shaped and having a pair of tubular end portions adapted to be attached to the booms and a central portion extending between the end portions, a pair of means on the central portion for securing an outhaul line extending in a direction approximately parallel to a second plane which bisects the booms perpendicularly to said first plane, and a sheave on the central portion having an axis which extends perpendicualarly to the plane of the U-shaped boom end part.

2. The structure of claim 1 in which the sheave includes a roller which is rotatably mounted on the boom end part for rotation about said axis.

3. The structure of claim 1 in which one of said means for securing an outhaul line includes a slot in the boom end part which extends parallel to said plane and means in the slot for providing a jam cleat for the outhaul line.

4. The structure of claim 3 in which said slot extends generally parallel to a plane which bisects the U-shaped boom end part.

5. The structure of claim 3 in which said slot has opposed, generally parallel surfaces, the jam cleat being provided by ridges which extend from each of the slot surfaces toward the other slot surface.

6. The structure of claim 5 in which said cleat ridges include peaks which are inclined relative to said side surfaces for providing a wedging action on the outhaul line.

7. The structure of claim 1 in which said pair of means for securing an outhaul line includes a pair of generally parallel slots which extend generally parallel to a plane which bisects the U-shaped boom outhaul end part, and means in each slot for providing a jam cleat for the outhaul line.

8. The structure of claim 7 in which each of said slots has opposed, generally parallel surfaces, the jam cleat in each slot being provided by ridges which extend from each of the slot surfaces toward the other slot surface.

9. The structure of claim 7 in which the boom end part has top and bottom surfaces, said pair of slots being provided in one of said surfaces and said sheave being mounted on the other of said surfaces.

10. The structure of claim 9 in which said central portion of the boom end part includes a curved rear surface, said pair of slots extending through said curved rear surface.

11. The structure of claim 1 in which the boom end part, with the exception of the sheave, is integrally molded.

12. In a mast assembly for a sailboard comprising a mast, a pair of booms mounted on the mast and extending generally perpendicularly thereto, a sail attached to the mast and extending between the booms, and a pair of sheaves on the tack on the sail, the improvement comprising a generally U-shaped boom end part having a pair of ends attached to the booms and a central portion extending between the ends, a sheave on the central portion having an axis which extends generally perpendicularly to the plane of the U-shaped boom end part, a pair of means on the boom end part for securing an outhaul line, and an outhaul line which extends from one of said securing means to one of said sheaves on the sail in a direction generally parallel to a plane which bisects the booms and extends parallel to the mast, said outhaul line extending around the sheave on the boom end part and around the other sheave on the sail, the outhaul line extending from said other sheave on the sail to the other of said securing means in a direction generally parallel to said plane.

13. The structure of claim 12 in which one of said means for securing the outhaul line includes a slot in the boom end part which extends parallel to said plane and means in the slot for providing a jam cleat for the outhaul line.

* * * * *